US005966880A

United States Patent [19]

Bridges et al.

[11] Patent Number: 5,966,880

[45] **Date of Patent: *Oct. 19, 1999**

[54] PVC WINDOW CLADDING WITH CORNER EXPANSION JOINTS

[75] Inventors: Alan M. Bridges, Clemmons, N.C.; Michael M. May, Stillwater, Minn.

[73] Assignee: East Millwork Distributors, Inc., Elkin, N.C.

[ * ] Notice: This patent is subject to a terminal disclaimer.

[21] Appl. No.: 08/806,620

[22] Filed: Feb. 26, 1997

Related U.S. Application Data

[63] Continuation of application No. 08/266,339, Jul. 1, 1994, Pat. No. 5,651,222.

[51] Int. Cl.[6] ..... E06B 1/04

[52] U.S. Cl. ..... 52/211; 52/212; 52/656.2; 52/656.9; 52/717.01

[58] Field of Search ..... 52/211, 212, 302, 52/656.9, 204.53, 656.2, 717.01

[56] References Cited

U.S. PATENT DOCUMENTS

| | | | |
|---|---|---|---|
| 3,812,621 | 5/1974 | Ragland | 52/212 X |
| 4,136,496 | 1/1979 | Molyneux | 52/302 |
| 4,240,765 | 12/1980 | Offterdinger . | |
| 4,341,048 | 7/1982 | Minter | 52/204.53 |
| 4,608,800 | 9/1986 | Fredette . | |
| 4,719,729 | 1/1988 | Wynar | 52/212 X |
| 4,742,647 | 5/1988 | Pacca . | |
| 4,831,781 | 5/1989 | Morton . | |
| 4,924,631 | 5/1990 | Davies et al. . | |
| 4,996,814 | 3/1991 | Guillemet . | |
| 5,182,880 | 2/1993 | Berge et al. | 52/211 X |
| 5,651,222 | 7/1997 | Bridges | 52/211 |

*Primary Examiner*—Beth Aubrey
*Attorney, Agent, or Firm*—Blank Rome Comisky & McCauley LLP

[57] ABSTRACT

A window frame assembly including a weather resistant cladding structure having a telescopic expansion joint. The cladding, preferably made of PVC, has side jamb members which are hollow and which form telescoping members in conjunction with corner pieces or end caps which engage with the nose of the sill cladding. The window frame assembly is made up of wooden side jambs, a wooden upper jamb and a wooden sub sill to which the cladding structure is attached. The telescopic members having the expansion joint permit thermal contraction and expansion of the cladding structure relative to the wooden jamb and sill members.

4 Claims, 4 Drawing Sheets

FIG. 3
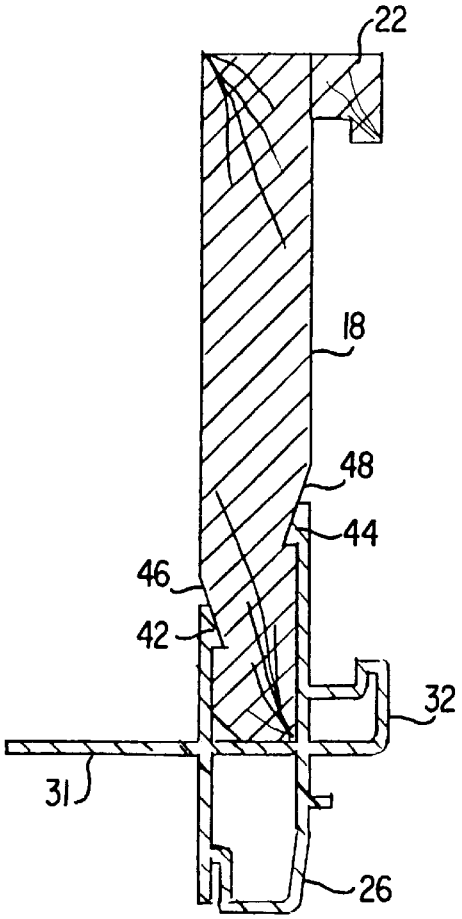
FIG. 4
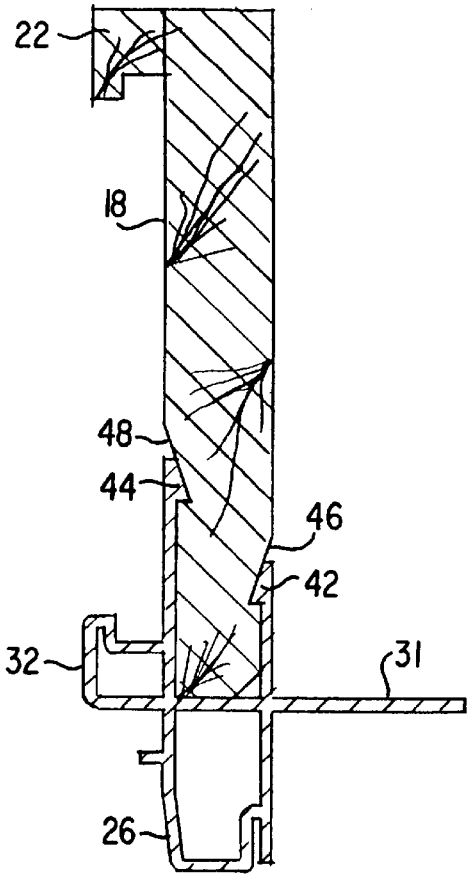
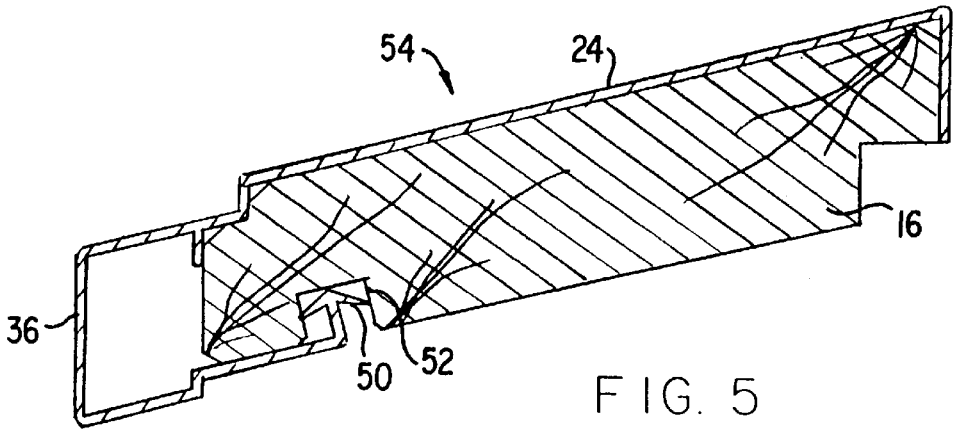
FIG. 5

FIG. 7
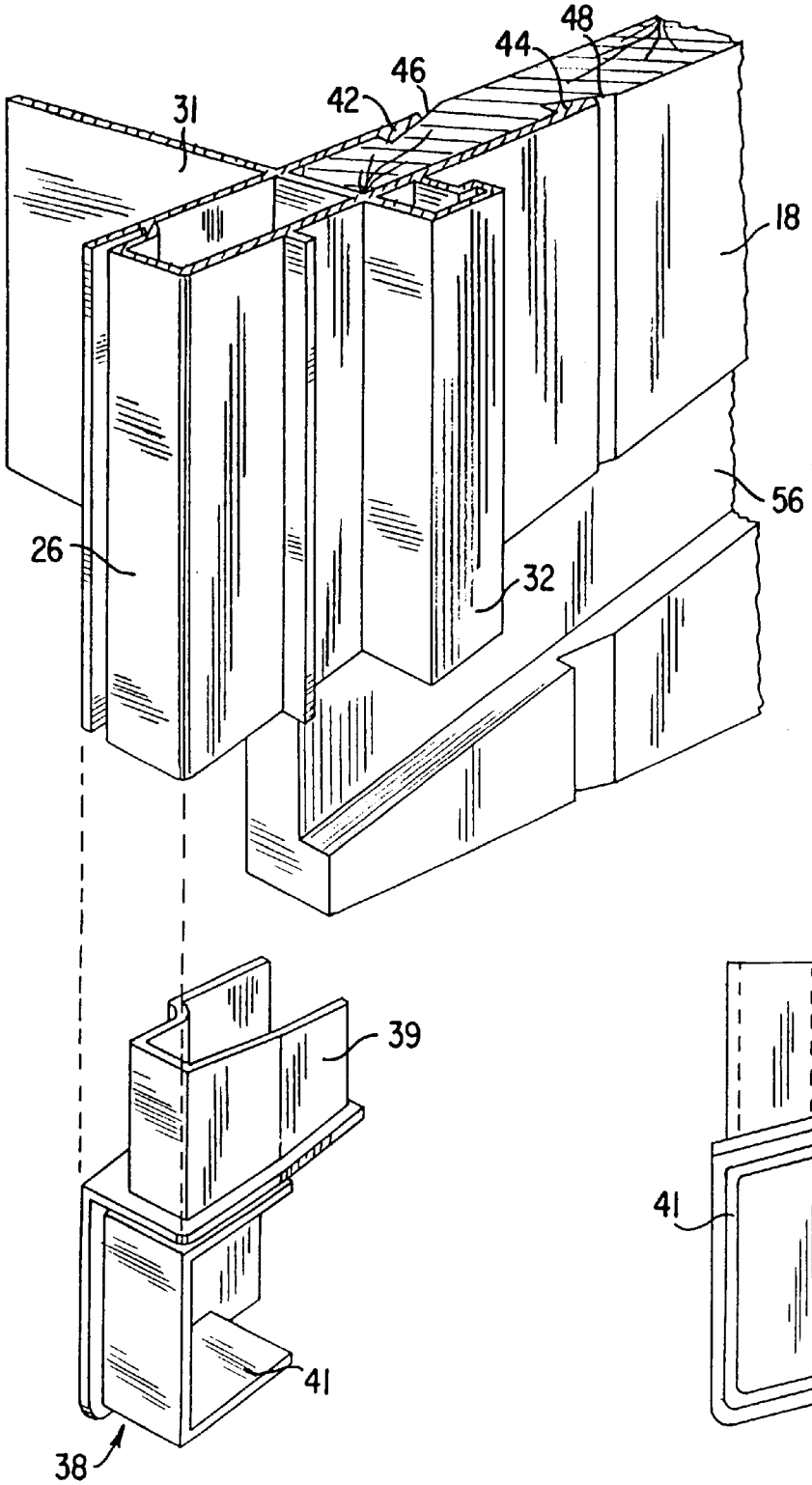
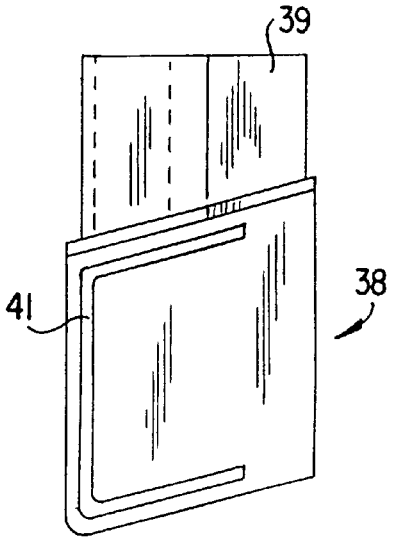
FIG. 8

PVC WINDOW CLADDING WITH CORNER EXPANSION JOINTS

RELATED APPLICATION

This application is a continuation of application Ser. No. 08/266,339, filed Jul. 1, 1994, now U.S. Pat. No. 5,651,222, the full disclosure of which is hereby incorporated by reference.

FIELD OF THE INVENTION

The present invention is directed to clad windows, in particular double hung windows, in which an external weather resistant cladding is providing and in which provision is made for thermal expansion and contraction of the cladding material.

BACKGROUND OF THE INVENTION

Clad windows are designed to provide maintenance free exterior surfaces while maintaining a traditional wood interior. Typically the cladding material is a skin of aluminum or plastic preferably polyvinylchloride (PVC). PVC provides good weather-resistance but has shortcomings. Specifically, PVC cladding undergoes dimensional changes as the ambient temperature it is exposed to changes. The total change in length of a 6 foot length of PVC cladding can be as much as 7/16 of an inch. This expansion and contraction not only creates gaps in the cladding, but also results in large stresses at the corner sections. These high stresses are detrimental to the cladding because they can cause corner joints to open, welded corners to break and allows water to penetrate the system, degrading the wood substrate beneath the cladding.

SUMMARY OF THE INVENTION

The present invention addresses the shortcomings of the prior art clad windows by providing a cladding structure which covers the outside edges of the upper and side jambs and the sill edge and sill surface with a weather resistant material such as aluminum or polyvinylchloride (PVC). The cladding structure is formed of hollow tubular members (typically extruded) which include at least two vertically extending telescopic side jamb cladding members. These telescopic members are arranged to permit thermal expansion and contraction of the window in the direction of its longest dimension (i.e., height for a vertically oriented window). The telescopic members are made up of a corner piece or end plug and a vertical hollow tubular member. The corner piece fits inside the sill nose, sealing that section. The frame cladding fits over the top of the corner pieces with a section of the corner piece extending vertically into the frame cladding. This vertical section extends far enough into the frame cladding that even at the coldest temperatures and maximum contraction, there is sufficient overlap to eliminate any discontinuity in the telescopic member. This performs both an aesthetic and a practical function. Aesthetically, it eliminates most of the perceived gap between the end of the frame cladding and the sill nose. Practically, it reduces the amount of stress that the top corner joint undergoes, eliminating the potential for cracks or open joints.

BRIEF DESCRIPTION OF THE DRAWINGS

FIG. 3 is a cross-sectional view of the left side assembly of the window frame taken along the line 3—3 of FIG. 1;

FIG. 4 is a cross-sectional view of the right side assembly of the window frame taken along the line 4—4 of FIG. 1;

FIG. 5 is a cross-sectional view of the sill assembly of the window frame taken along the line 5—5 of FIG. 1;

FIG. 7 is an expanded detailed view of the lower left corner of the window frame showing insertion of the corner plug; and FIG. 8 is a detailed cross-sectional view of the corner plug inserted in the sill.

DETAILED DESCRIPTION OF THE DRAWINGS

Figure 1:
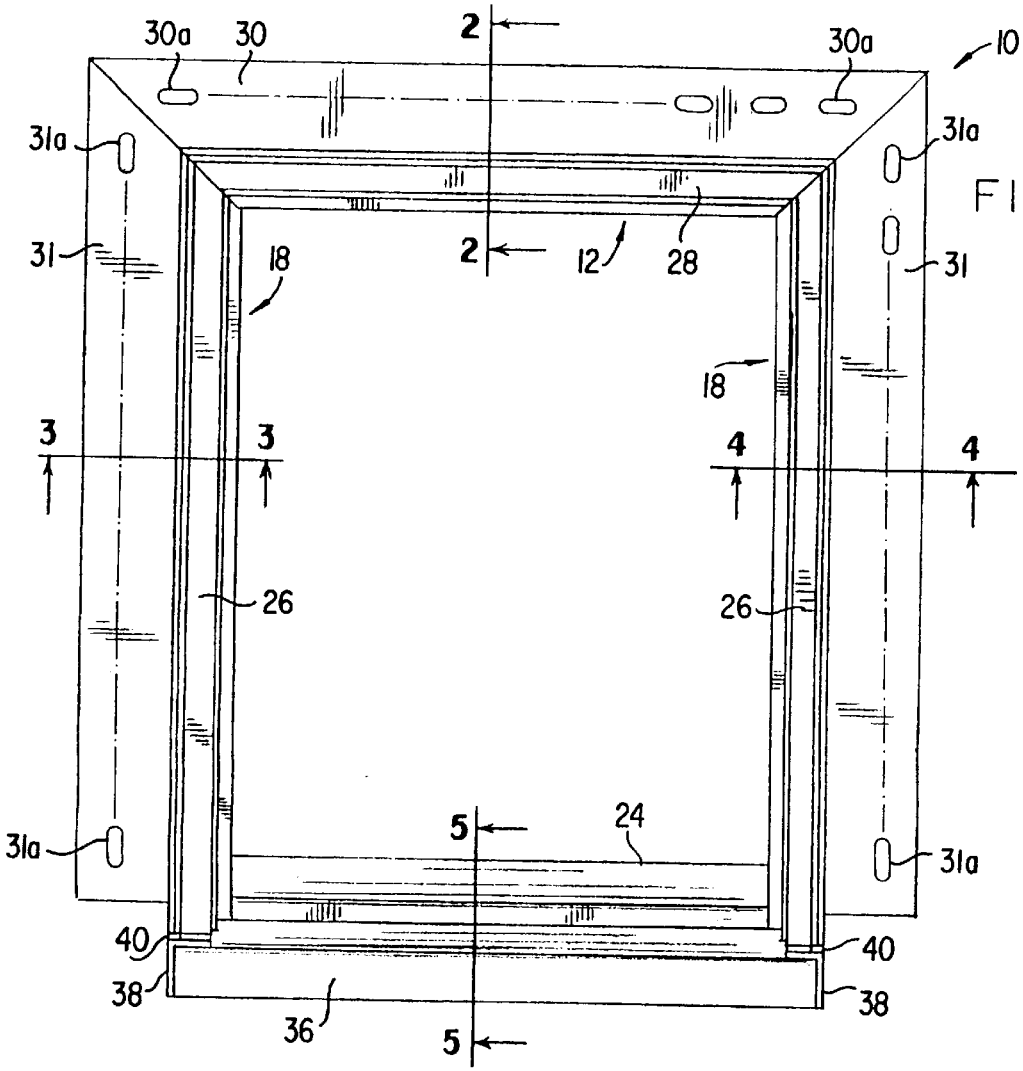
FIG. 1 is an elevational view of the outside of the frame for a double-hung window assembly construction in accordance with the invention.
Figure 2:
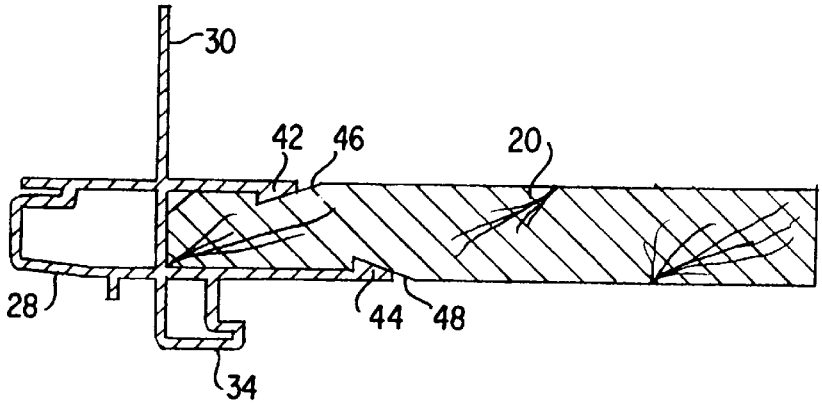
FIG. 2 is a cross-sectional view of the head assembly of the window frame taken along the line 2—2 of FIG. 1.
Figure 6:
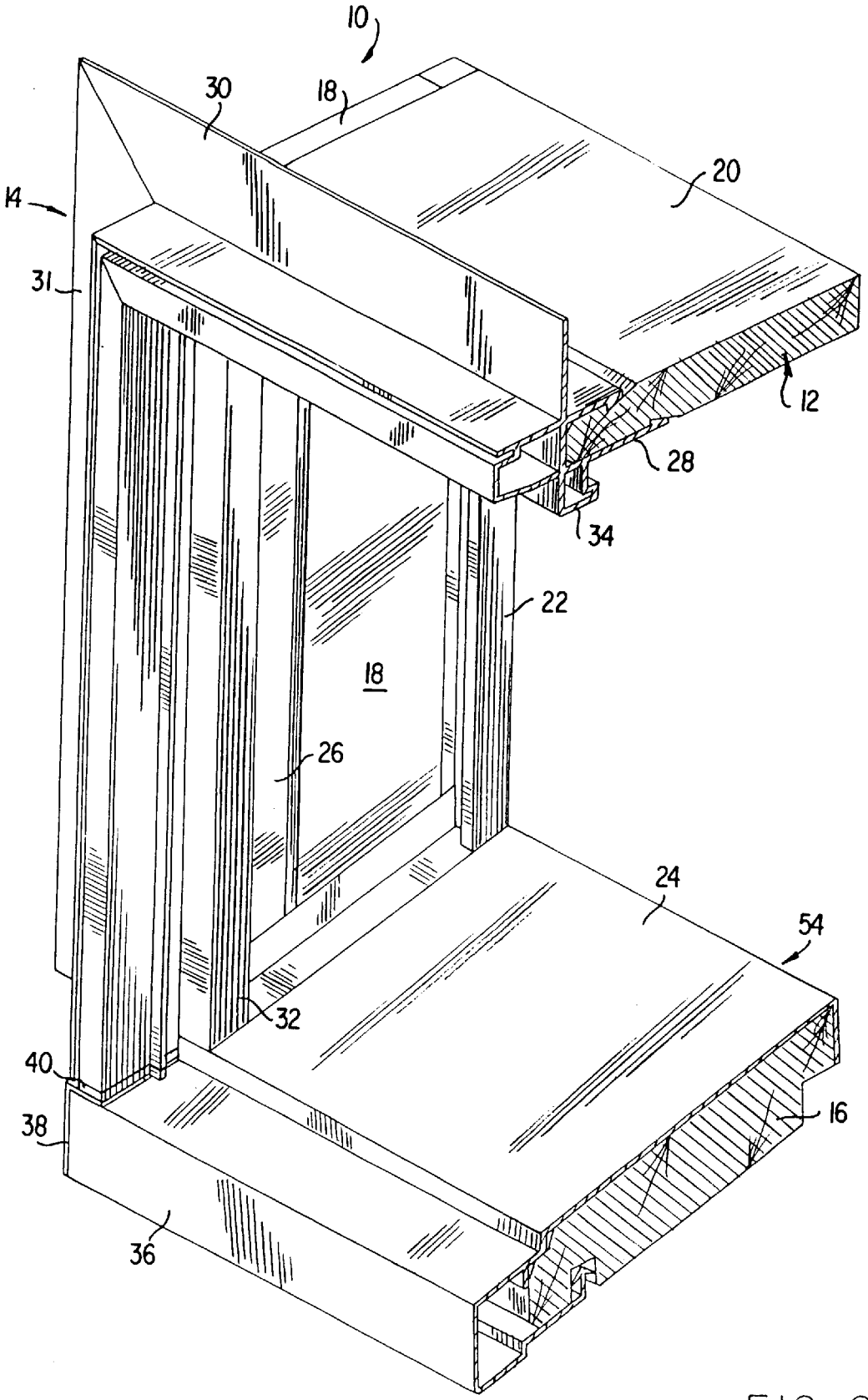
FIG. 6 is a perspective view, partly in cross-section of the left side of the window frame of FIG. 1.

Referring now to the drawings, wherein like elements are designated by like numerals throughout, a window frame assembly, generally designated by the numeral 10, having a sill corner piece permitting expansion and contraction according to the invention is shown in FIGS. 1, 6, 7 and 8. Other details of the window frame assembly 10 construction are shown in FIGS. 2–5. FIG. 1 shows the outer surfaces of the window frame assembly 10. FIGS. 6 and 7 show the construction of the window assembly 10 including the wood frame 12 underlying a cladding structure 14. Wood frame 12 and cladding structure 14 are made of different materials (PVC or aluminum for cladding structure 14). As a result, there is different thermal expansion and contraction which is accounted for by the structure of the cladding.

As shown in FIGS. 6 and 7, the window frame assembly 10 is made of a wood frame 12 having a sub sill 16, two vertically extending side jambs 18 and head jamb 20, each preferably made of wood, which are primarily responsible for providing the structural integrity and natural aesthetic appearance of the window frame assembly 10. An inside stop 22, preferably of wood, is provided on each side jamb 18.

Cladding structure 14 is attached to and overlies the wood frame 12. Cladding structure 14 is made up of sill cladding 24, side jamb cladding 26 and head jamb cladding 28. Head nailing fin 30, having a plurality of elongated nailing holes 30*a* arranged around the periphery thereof, is formed with or attached to the periphery of head jamb cladding 28 and side jamb nailing fin 31, having a plurality of elongated nailing holes 31*a* arranged around the periphery thereof, is similarly formed with or attached to side jamb cladding 26. Side jamb cladding 26 and head jamb cladding 28 have formed thereon, respectively, outer stops 32, 34. A sill cladding nose 36 is formed on still cladding 24. Sub sill 16 and sill cladding 24 are inclined, as shown in FIGS. 5 and 6, so as to permit water to drain toward the outside.

Side jamb cladding 26 is formed as a telescoping member in which a male corner piece or end plug 38 engages the female side jamb cladding 26 with vertical portion 39 and sill cladding nose 36 with horizontal portion 41. The elements overlap, but have a gap 40, expandable and contractible in dimension, which is provided between side jamb cladding 26 and end plug 38. As explained below, in the assembly of the window frame assembly 10, barbs 42, 44 are slidably engaged in grooves or kerfs 46, 48 in side jambs 18. As the cladding structure 14 expands and contracts relative to the wood frame 12, the side jamb claddings 26 slide relative to side jambs 18 and gap 40 grows or shrinks. This telescopic arrangement permits the window frame cladding structure 14 to expand and contract.

End plug 38 is shown formed as a separate element. However, as an alternative embodiment, it is contemplated that end plug 38 can be attached to or formed integral with sill cladding nose 36. It is also contemplated that an alternative (but less aesthetically desirable) location of the end plug 38 would be at the upper corners between side jamb cladding 26 and head jamb cladding 28, with a corresponding gap 40 formed at such location. Finally, it is contemplated that sill cladding nose 36 can be provided at each end with an appropriately arranged female receptacle for receiving a male corner piece attached to or formed integral with side jamb cladding 26.

As is shown in the drawings, a frame assembly for a double hung window is contemplated. The window panes themselves (not shown) are mounted in the frame assembly in known manner between stops 22 and 32. However, it is contemplated that other types of windows can use the present invention.

The window frame assembly 10 is assembled as follows: head jamb 20 is secured to right and left side jambs 18 by nails, staples or other suitable fasteners. Inside stops 22 are positioned and fastened to the right and left side jambs 18. This forms a wooden subassembly. The subassembly is then turned over.

Right and left side jamb cladding 26 is cut to length and welded, fusion welded or otherwise fastened to head jamb cladding 28 at 45° angle to make 90° corners. The resulting cladding subassembly is snapped onto the wood subassembly such that the barbs 42, 44 fit into grooves or kerfs 46, 48 and locked into place.

The sill cladding 24 is positioned over the wood sub sill 16. However, initially sill barb 50 is not driven into groove 52 in sub sill 16, so that sill cladding 24 can be moved left to right on the sub sill 16 so as to make a proper final fit.

Corner plugs 38 are fitted to the ends of side jamb cladding 26. An adhesive is applied to the part of corner plug which engages the sill nose 36 of the sill cladding 24. The side jambs 18 are spread outwardly to provide clearance for the sub sill 16 and sill cladding 36. The cladded sill 54 is inserted into the groove or dado 56 of side jambs 18. At the same time as cladded sill 54 is inserted, the corner plugs 38 are worked into the sill nose 36 of the sill cladding 24. Once the cladded sill 54 is correctly positioned, it is secured with nails, staples or other suitable fasteners through the side jambs 18. The sill barb 50 is then driven into groove 52 of sub sill 16. The window frame assembly 10 is then completed and ready for the window panes to be installed.

A simplified Table showing expected thermal expansion and contraction for a 72" high window assembled with a 0.125 inch gap 40 at 75° and assumed to be at a uniform temperature is provided below:

| PART TEMPERATURE | 72" CHANGE IN LENGTH | GAP |
|---|---|---|
| −20° F. | −.239 | +.364 |
| 0° F. | −.189 | +.314 |
| 20° F. | −.139 | +.264 |
| 40° F. | −.089 | +.213 |
| 60° F. | −.038 | +.163 |
| 80° F. | +.013 | +.112 |
| 100° F. | +.063 | +.062 |
| 120° F. | +.113 | +.012 |

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A window frame assembly comprising:

an inner frame having an inner periphery and an outer periphery, an outer cladding for engaging the outer periphery of said inner frame, said outer cladding including cladding members having lengths which extend and retract in a longitudinal direction in response to thermal expansion and contraction of said outer cladding, said cladding members engaging with each other such that said cladding members overlap in a male-female fashion so as to telescope in the longitudinal direction during thermal expansion and contraction, wherein said cladding members which extend and retract are vertically arranged hollow tubular members which engage end caps and wherein further a gap is provided between each hollow tubular member and each end cap, said gap increasing upon thermal contraction of said tubular member which extends and retracts and said gap decreasing upon thermal expansion of said tubular member which extends and retracts.

2. A window frame cladding assembly for engaging an outer periphery of an inner frame, comprising:

an outer cladding for engaging the outer periphery of the inner frame, said outer cladding including three-dimensional non-planar cladding members having lengths which extend and retract in a longitudinal direction in response to thermal expansion and contraction of said outer cladding, said three-dimensional non-planar cladding members engaging with each other such that said cladding members overlap in a male-female fashion so as to telescope in the longitudinal direction during thermal expansion and contraction;

an end cap, wherein a gap is provided between each said telescoping three-dimensional non-planar member and each end cap, said gap increasing upon thermal contraction of said three-dimensional non-planar member and decreasing upon thermal expansion of said three-dimensional non-planar member.

3. A window frame assembly comprising:

an inner frame having an inner periphery and an outer periphery, an outer cladding for engaging the outer periphery of said inner frame, said outer cladding including cladding members having lengths which extend and retract in a longitudinal direction in response to thermal expansion and contraction of said outer cladding, said cladding members engaging with each other such that said cladding members overlap in a male-female fashion so as to telescope in the longitudinal direction during thermal expansion and contraction, wherein said cladding members which extend and retract include a pair of hollow vertical tubular members each engaging an end cap attached to a head portion of said cladding.

4. A window frame assembly as in claim 3, wherein each end cap has a first male portion for engaging said hollow vertical tubular members and a second male portion for engaging said head portion.

* * * * *